US005725444A

United States Patent [19]

Heden

[11] Patent Number: 5,725,444

[45] Date of Patent: Mar. 10, 1998

[54] DEVICE FOR TRAINING SOCCER PLAYERS

[76] Inventor: Donald G. Heden, 3902 Sunstone Dr., Houston, Tex. 77068

[21] Appl. No.: 819,702

[22] Filed: Mar. 12, 1997

Related U.S. Application Data

[60] Provisional application No. 60/013,448, Mar. 15, 1996.

[51] Int. Cl.[6] ..... A63B 63/00

[52] U.S. Cl. ..... 473/446; 273/400

[58] Field of Search ..... 473/446; 273/400, 273/401

[56] References Cited

U.S. PATENT DOCUMENTS

| | | | |
|---|---|---|---|
| 1,527,988 | 3/1925 | McMurtrie | 273/400 |
| 3,580,578 | 5/1971 | McCarthy | 273/401 X |
| 3,822,883 | 7/1974 | De Vos | 273/400 |
| 3,856,298 | 12/1974 | Frantti | 473/446 |
| 4,492,380 | 1/1985 | Saytar | 273/400 X |
| 4,497,485 | 2/1985 | Macosko | 273/401 X |
| 4,921,257 | 5/1990 | Heller | 473/446 |
| 5,000,461 | 3/1991 | Borazjani | 273/401 |
| 5,037,095 | 8/1991 | Nedwick | 273/400 X |
| 5,096,191 | 3/1992 | Fang | 273/400 X |
| 5,181,725 | 1/1993 | Leras et al. | 473/446 |
| 5,217,230 | 6/1993 | Judd | 273/401 |
| 5,238,243 | 8/1993 | Grispi | 473/446 |
| 5,277,430 | 1/1994 | Naccarato | 473/446 |
| 5,503,402 | 4/1996 | Moss, Jr. | 273/400 |
| 5,516,115 | 5/1996 | McLain | 273/401 |
| 5,571,266 | 11/1996 | Nichols | 473/446 |

OTHER PUBLICATIONS

Goal Products, Inc., Garage Goal, 1996 (Website).

*Primary Examiner*—William H. Grieb
*Attorney, Agent, or Firm*—Arnold, White & Durkee

[57] ABSTRACT

A device for training soccer players having a rectangular net body and a plurality of pockets. The rectangular net body and pockets are made of flexible net material. The rectangular net body has a plurality of apertures. Each pocket is attached to the perimeter of each aperture and sized to receive at least one soccer ball. The training device may be used in conjunction with a game to develop a player's foot and shooting skills.

20 Claims, 11 Drawing Sheets

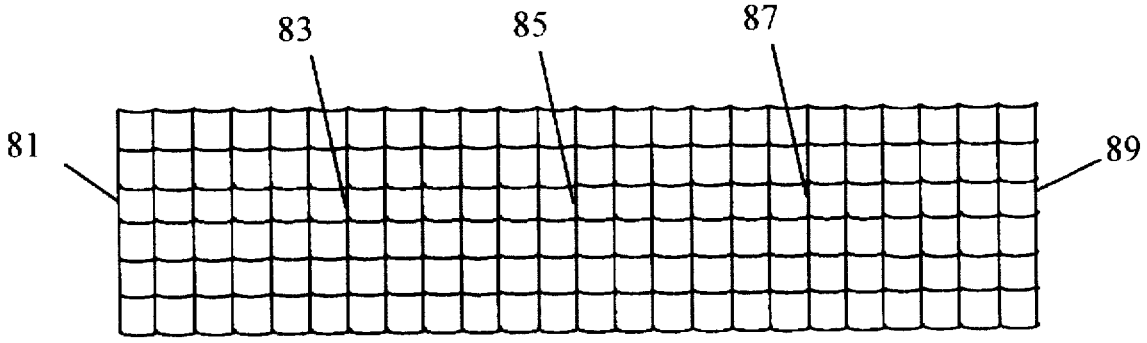
Fig. 6
Fig. 7
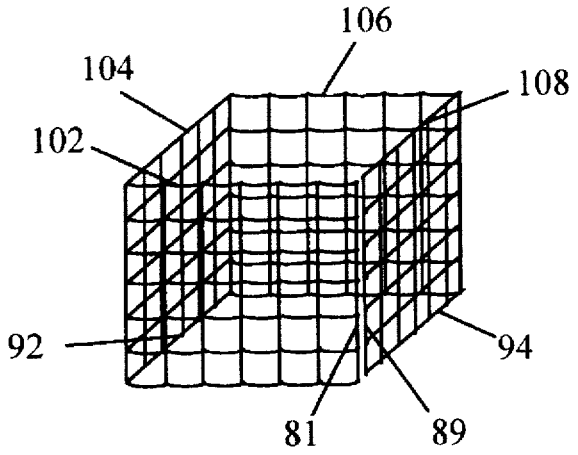
Fig. 8
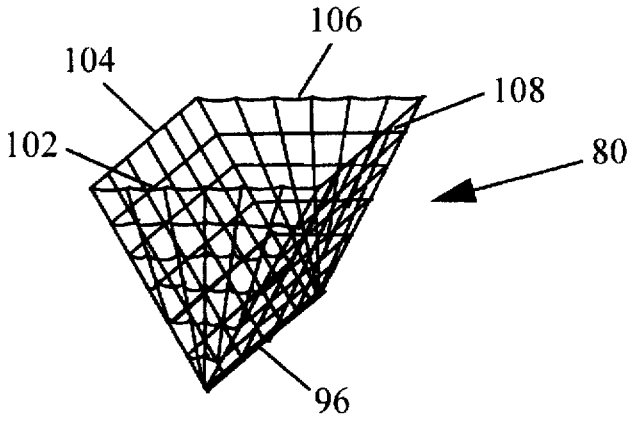

DEVICE FOR TRAINING SOCCER PLAYERS

BACKGROUND OF THE INVENTION

The present application claims priority from provisional application Ser. No. 60/013,448 entitled "Device For Playing Soccer and Training Soccer Players" filed Mar. 15, 1996.

1. Field of the Invention

This application relates to a device for playing soccer and training soccer players. More particularly, it relates to soccer nets consisting of pockets placed at strategic locations to increase a players' shooting skills.

2. The Prior Art

Soccer is a popular sport throughout the world and has gained widespread interest in the United States. An important skill for a soccer player to develop is shooting and scoring. Shots must be both accurate and powerful. Typically, players must travel to a soccer field in order to practice shooting skills. Besides the inconvenience, it is also difficult to simulate and practice strategic shots without additional players.

It is also known that players mark targets on large rigid walls to develop shooting skills. Each shot, however, must be carefully watched to determine whether a particular target is hit. If multiple players are shooting at the same target, the task of observing which ball hit a particular target becomes even more difficult. Moreover, the rigid wall increases the risk of injury to a player. Further, the simulation of real game situations is limited.

For indoor soccer, it is known that a rigid metal or hard plastic structure is used to support a soccer net. A collision may occur, however, between a player and the hard plastic or metal structure causing life threatening injuries to the head or serious injuries to the rest of a player's body.

Other examples of prior art include U.S. Pat. No. 1,527,988 (McMurtrie) that discloses a net device comprising entirely of cells and used to play a game with a golf ball. U.S. Pat. No. 3,580,578 (McCarthy) discusses a goal for a bouncing ball game. U.S. Pat. No. 4,492,380 (Saytar) discloses a goal assembly for a modified basketball and hockey game. U.S. Pat. No. 3,822,883 (De Vos) discloses a target with compartments for playing a ball game where a ball is thrown into the compartments for points. U.S. Pat. No. 4,497,485 (Mascosko) discloses a baseball pitching target. U.S. Pat. No. 5,037,095 (Nedwick) discloses a quarterback trainer apparatus. U.S. Pat. No. 5,096,191 (Fang) discloses a basketball training apparatus with hoops. None of the references, however, contains the suggestion that the device may be modified for soccer and used for developing a player's foot and shooting skills.

Several devices that might be used for soccer have previously been proposed, but they suffer from several deficiencies. For example, U.S. Pat. No. 4,921,257 (Heller) discloses a training device that is limited for use in connection with a conventional soccer goal. U.S. Pat. No. 5,000,461 (Borazjani) discloses a complex device which can reposition a single target cup; however, this device is prohibitively expensive to manufacture. Although it is suggested that the device in U.S. Pat. No. 5,000,461 (Borazjani) may be modified with a covering having circular holes without pockets, the device still uses a bulky frame. U.S. Pat. No. 5,217,230 (Judd) shows a multi-sports net with a single pouch being attached to the net by a rigid tubular ring of circular configuration. This tubular ring assembly is also prohibitively expensive to manufacture.

The present invention is directed to overcoming, or at least reducing the effects of, one or more of the problems set forth above.

SUMMARY OF THE INVENTION

It is a primary object of this invention to provide a soccer training device that may rapidly increase a player's foot and shooting skills.

It is another important object of this invention to provide a training device that is lightweight, portable and easy to assemble and install.

A further object of this invention is to provide a training device that may be used at the convenience of a player's residence.

Yet another object of this invention is to provide a device that develops a player's foot and shooting skills without help from additional players.

A still further object of the invention is to provide a training device that lessens the risk of injury when simulating real game situations.

Another object of this invention is to provide an inexpensive training device to soccer players.

An even further object of this invention is to provide a single training device that may be attached to a variety of structures.

Still yet another object of this invention is to provide a training device that maintains the interest of young soccer players.

Still another object of this invention is to provide a training device that may be used for a superior cardiovascular workout to both young and older athletes.

In accordance with the present invention, the foregoing objectives are realized by providing a lightweight training device having multiple pockets placed at strategic locations that are sized to receive one or more soccer balls. By targeting specific parts within the goal area, a player may increase his or her foot and shooting skills. Unlike the prior art, the device of this invention allows trainers, coaches and players to accurately observe whether a player strikes a particular location within the goal area. The device of this invention is portable and may be rolled up and stored in a draw-string bag. Further, the device is easy to use. The device stretches across pre-existing structures such as a garage door frame, a soccer goal frame, between two trees, or between two large vehicles. Using pre-existing frames or other structures further reduces the cost of using the training device. The training device may also be used in conjunction with a game to maintain the interest of young soccer players as well as develop a player's foot and shooting skills. The game also provides a great cardiovascular workout to both young and older athletes.

In one embodiment of the invention, the device is a garage door soccer net. The garage door soccer net has a main net body that is rectangular in shape. The corners of a soccer goal are difficult for a goalie to defend during a soccer game. Accordingly, two pockets sized to receive one or more soccer balls are located at the upper corners of the garage door soccer net. A third pocket in the middle portion of the garage door soccer net represents the goalie position. The pockets are attached to the perimeter of apertures on the main net body. The apertures allow the soccer ball to pass through the main net body and into a pocket. The main net body and pockets are made of knitted nylon, cotton, hemp, polypropylene, rayon or any other natural or synthetic fiber suitable for netting. The outer border of the net is reinforced with an outer cord. The net may be stretched across the opening of a garage door frame. The four corners of the garage door net are attached to hooks or screws located on the garage door frame. For additional support, the top edge and sides of the net may be attached to one or more mounting hooks located along the garage door frame. The garage door frame provides structural support for the net. Alternatively, the garage door soccer net may be hung from hooks on the caves on a house and staked to the ground or attached to the outer frame of a youth soccer goal. The garage door soccer net may also be inverted so that the upper corner pockets become the lower corner pockets. Upper corner pockets allow a player to develop kicking skills as well as scoring by hitting the ball with the player's head, also called heading. Lower corner pockets enable a player to practice chip shots or rapid ground shots, also known as turf burners.

In another embodiment, the garage door soccer net may be used in conjunction with a game to help develop a player's foot and shooting skills and to maintain the interest of young soccer players. One game is played with a garage door soccer net, a soccer ball and at least two opposing players. Points are scored by kicking the soccer ball into the main net body or by kicking the soccer ball into one of the two corner pockets. Higher points are awarded for kicking the soccer ball into one of the two corner pockets. To encourage younger players in using their head to score goals, even higher points may be awarded to a player that knocks a soccer ball into an upper corner pocket using his or her head. The game may be played with or without a goalie. If no goalie is used, the ball is turned over to the opposing player if the ball is kicked into the middle pocket. If the middle pocket is guarded by a goalie, points are awarded if a player kicks the soccer ball into the middle pocket. In another game, the garage door soccer net has colored pockets. Each player is designated a different colored pocket. Points are scored by kicking the ball into the player's designed pocket.

In still another embodiment, the device is a full size training net. The full size training net has a main net body and pockets at all four corners. The full size training net also has a center pocket representing the goalie position. The pockets are attached to the perimeter of apertures on the main net body. The apertures enable a soccer ball to pass through the main net body and into a pocket. The training net is larger than the garage door soccer net and may be stretched across the outer frame of a soccer goal. The top edge and sides of the training net may be attached to the frame of a soccer goal by using a variety of methods such as bungee cords, Velcro straps, nylon tie wraps or rope. The outer frame of the soccer goal provides structural support for the training net. The bottom edge of the training net may be attached to the ground with stakes for additional support. The training net provides a valuable tool for coaches and trainers. The pockets may be color coded to distinguish one pocket from another. As a player dribbles toward the training net, the coach may call out a color that the player must instantly shoot for. During an actual scrimmage, one team can take a pocket of one color and the other team a pocket of a different color thus creating a very fast pace game with rapid switches from offense to defense. This develops both the body and the mind causing a player to make snap decisions.

In yet another embodiment of this invention, the device is a gym ball net. The gym ball net also has a main net body and multiple pockets but is stretched across the inside of a gymnasium or other large enclosure. The pocket locations on the gym ball net represent the four corners of a full size soccer goal having a width of 24 feet and a height of 8 feet. It is recommended that the width of the gym ball net extend at least 4 feet past the outer edge of the corner pockets on each side and at least 4 feet above the top edge of the upper corner pockets. The net extends beyond the corner pockets, both in height and width, to protect the wall of the gymnasium and to gently deflect the ball back into the field of play. The gym ball net provides a sturdy net or goal area that can receive power shots from large or strong players without damaging the net. A further object of the gym net is to establish a safe goal area with no hard plastic or steel supports that could injure a player. The bottom edge of the gym ball net is attached to flush mounted receptacles on the gymnasium floor. The top of the gym ball net is attached to rope or cords. The rope or cords are used in conjunction with pulleys on the ceiling of the gymnasium to lift the gym ball net into place. The top side of the gym ball net may be slightly tilted forward to assist in the return of missed shots. The unique design of the gym ball net eliminates all hard structures and becomes a catching device to catch and gently decelerate the forward motion of a player out of control.

In a further embodiment, the gym ball net may be used in conjunction with a game to enhance a player's soccer skills. The game is played with a gym ball net, a soccer ball and at least two opposing players or teams. The gym ball net has a colored ribbon or line on the main net body that represents the outline of a standard soccer goal. Points are scored by kicking the soccer ball into one of the corner pockets. Higher points may be awarded if a ball is knocked into a corner pocket by a player's head. This game may also be played with or without a goalie. A pocket is positioned in the center portion of the main net body to represent the goalie position. If no goalie is used, the ball is turned over to the opposing player if the ball is kicked into the unguarded center pocket. For a guarded center pocket, points are awarded if a player kicks the soccer ball into the center pocket.

BRIEF DESCRIPTION OF THE DRAWINGS

The following drawings form part of the present specification and are included to further demonstrate certain aspects of the present invention. The invention may be better understood by reference to one or more of these drawings in combination with the detailed description of specific embodiments presented herein.

FIGS. 6–8 are front and perspective views of an alternative pocket during the various steps of assembly.

Figure 1:
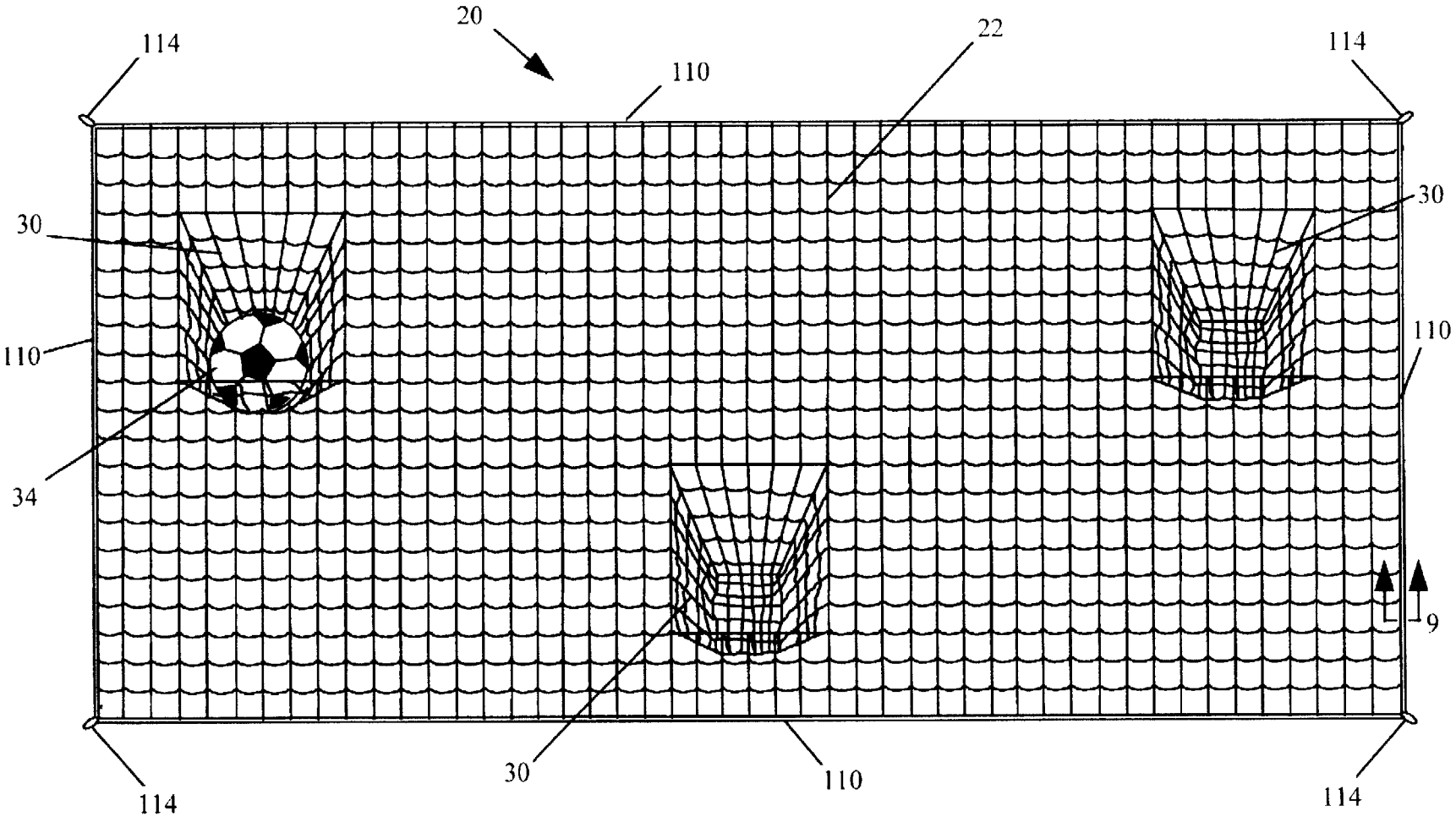
FIG. 1 is a front view of the garage door soccer net.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents and alternatives falling within the spirit and scope of the invention as defined by the appended claims.

DESCRIPTION OF ILLUSTRATIVE EMBODIMENTS

Figure 2:
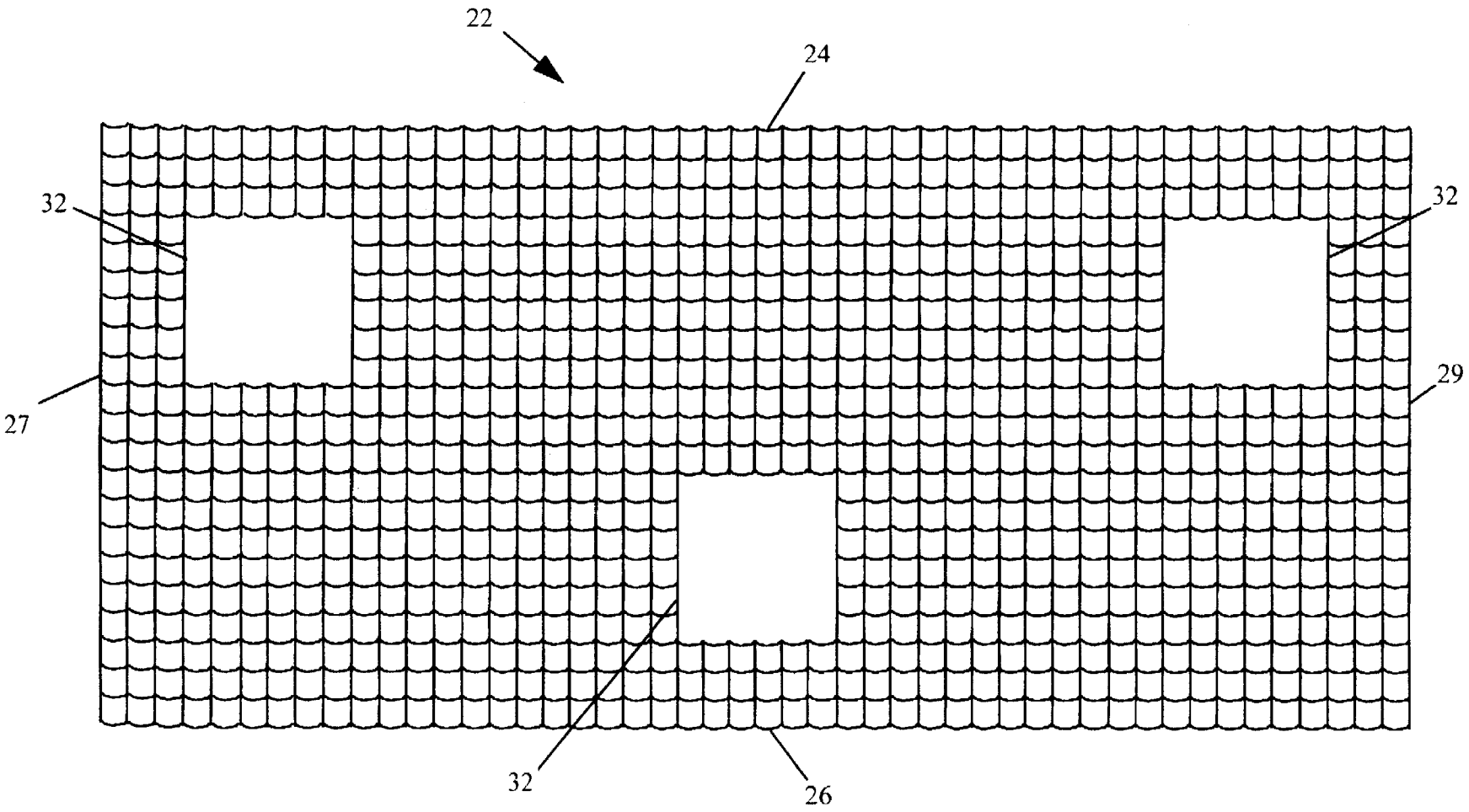
FIG. 2 is the front view of the main body of the garage door soccer net.

Turning now to the drawings and referring initially to FIGS. 1 and 2, one embodiment of the present invention is a garage door soccer net 20. The garage door soccer net 20 has a main net body 22 in the shape of a rectangle. The main net body 22 has a top edge 24, a bottom edge 26, a left side 27, and a right side 29. The garage door soccer net 20 is sized for a dual-car garage although it may be modified for a single-car garage. For a dual-car garage, the top edge 24 and bottom edge 26 have a length in the range of 15 to 18 feet. In the preferred embodiment, the top edge 24 and bottom edge 26 have a length of about 16 feet. For a single-car garage, the top edge 24 and bottom edge 26 may have a length in the range of 8 to 10 feet. The left side 27 and right side 29 have a height in the range of 6 to 8 feet or preferably about 6 feet 8 inches.

The main net body 22 is made front square mesh netting. The main net body 22 is formed by cutting the square meshing netting in the shape of a rectangle. The square mesh netting is made of knitted nylon, cotton, hemp, polypropylene, rayon or any other natural or synthetic fiber suitable for netting. The use of natural or synthetic fiber netting reduces the risk of injury to a player when simulating real game situations. Further, the use of natural or synthetic fiber netting allows the training device to be lightweight. The square mesh has a width and height in the range of 3 to 6 inches. In the preferred embodiment, the square mesh has a width and height of about 4 inches. The diameter of the net line is in the range of 1/16 to 1/4 inch.

The garage door soccer net 20 has a plurality of pockets 30. Each pocket 30 is attached to the perimeter of an aperture 32 on the main net body 22. In the preferred embodiment, the garage door soccer net 20 has at least three pockets 30 and three apertures 32 as shown in FIGS. 1 and 2. The pockets 30 and apertures 32 are shaped and sized to receive one or more soccer balls 34. Although the apertures 32 may be in the shape of a circle or an ellipse, the apertures 32 are preferably in the shape of a square or rectangle to match the square mesh netting. The apertures 32 are formed by cutting holes in the rectangular main net body 22. In the preferred embodiment, the pockets 30 are assembled in the shape of a cube or rectangular box. The top edges of a cubed or rectangular pocket 30 mate well with the square or rectangular aperture 32. Apertures 32 in the shape of a square or rectangle provide a greater surface area for attachment and allow for a stronger pocket 30. Manufacturing costs are also reduced because stitching is not complicated. The apertures 32 have a width in the range of 20 to 36 inches and a height in the range of 20 to 36 inches. In the preferred embodiment, the apertures 32 are in the shape of a square and have a width and height of about 2 feet. The opening of the pockets 30 also have a width in the range of 20 to 36 inches and a height in the range of 20 to 36 inches. The opening of the pockets 30 are shaped to match the apertures 32 on the main net body 22. The apertures 32 allow a soccer ball 34 to pass through the main net body 22 and into a pocket 30. The depth of the pockets 30 are in the range of 20 to 48 inches, but preferably about 24 inches.

The pockets 30 and apertures 32 are strategically sized and located to enhance a player's foot and shooting skills. The upper left-hand and upper right-hand corners of a soccer goal are difficult for a goalie to defend. Accordingly, the garage door soccer net 20 has pockets 30 and apertures 32 in the upper left-hand and upper right-hand corners. Preferably, the center of the upper left-hand corner aperture 32 is located between 4 and 5 feet from the ground and between 2 and 3 feet from the left side 27. The center of the upper right-hand corner aperture 32 is located between 4 and 5 feet from the ground and between 2 and 3 feet from the right side 29. Additionally, a pocket 30 and aperture 32 may be located in the lower middle portion of the garage door soccer net 20. The middle pocket 30 and middle aperture 32 represent the goalie position. In one embodiment, the center of the middle aperture 32 is located between 1 and 3 feet from the ground.

Figure 3:
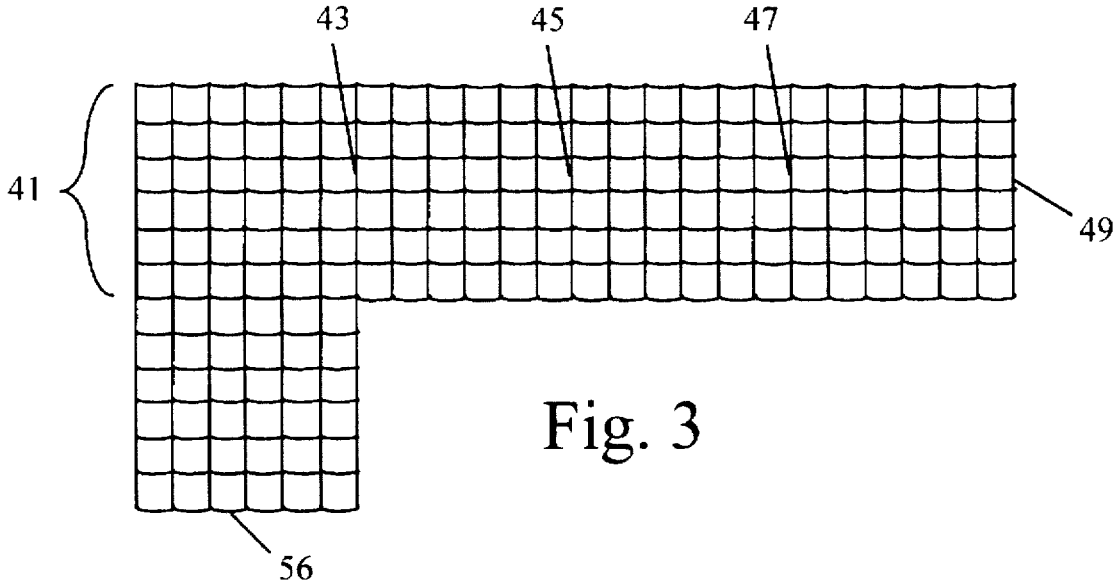
FIGS. 3–5 are front and perspective views of a pocket during the various steps of assembly.
Figure 4:
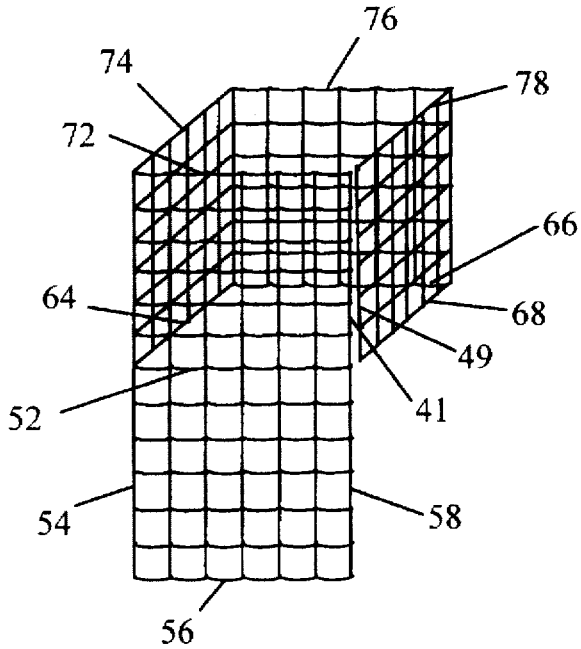
Figure 5:
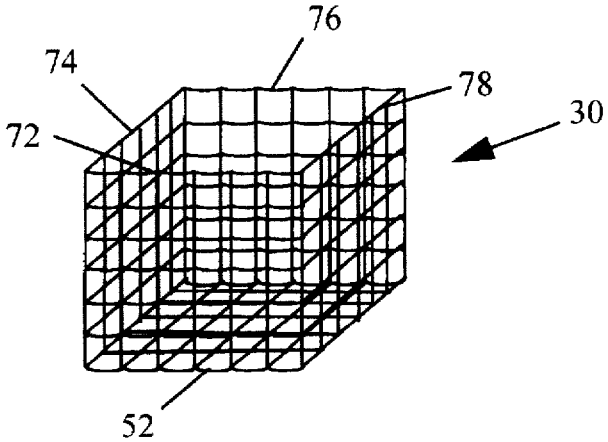

The pocket 30 may be assembled in the shape of a cube, a rectangular box, a pyramid, or a silo. In the preferred embodiment, the pocket 30 is assembled in the shape of a cube or a rectangular box. Pockets 30 in the shape of a cube or rectangular box further reduce manufacturing costs because they are easy to assemble. FIGS. 3–5 illustrate the various stages of assembly of a pocket 30 in the shape of a cube. FIG. 3 shows an unassembled cubed pocket 30. The cubed pocket 30 is made from the same material as the main net body 22, natural or synthetic fiber netting. The netting is square mesh having a width and height in the range of 3 to 5 inches, but preferably about 4 inches. The netting of the pockets 30 may be dyed different colors to distinguish one pocket from another. To construct the cubed pocket 30, the netting may be cut in the shape of an "L" as illustrated in FIG. 3. To form a cubed pocket 30 having a depth, width and height of about 2 feet, the long edge of the L-shaped net piece is about 8 feet in length. The L-shaped net piece is folded along the net lines 43, 45 and 47 to form the sides of the pocket as illustrated in FIG. 4. The side net lines 41 and 49 are then sewn together. The preferred sewing method is an overlock stitch. To form the bottom of cubed pocket 30, the bottom net piece is folded along the net line 52. To complete the bottom of the cubed pocket 30, the bottom of the pocket 30 is sewn to the sides of the pocket 30 (for example, bottom net line 54 is sewn to side net line 64, bottom net line 56 is sewn to side net line 66, and bottom net line 58 is sewn to side net line 68). FIG. 5 illustrates an assembled cubed pocket 30. Given the above description and drawings, it becomes apparent that various other ways exist to assemble the cubed pocket 30. For example, the cubed pocket 30 may be sewn together and assembled from five separate square pieces of netting or a combination of netting and fabric.

To distinguish one pocket from another, different pieces of color fabrics may be sewn or attached to the bottom or top of the cubed pocket 30. A colored piece of fabric may be attached to the bottom or back of the cubed pocket 30 with Velcro strips. Alternatively, a colored piece of fabric may be sewn to the bottom or back net lines of the cubed pocket 30.

The assembled cubed pocket 30 is attached to the perimeter of an aperture 32 on the main net body 22 by sewing the top edges 72, 74, 76 and 78 of the pocket 30 to the perimeter of the aperture 32. The preferred method of attachment is using an overlock stitch. Different color sewing thread may be used to further distinguish one pocket from another. Although the pockets 30 may be assembled in the shape of a cube or rectangular box, it is recognized that the pockets 30 do not hold their shape after being attached to the main net body 22. The pockets 30 are made of flexible netting material that will collapse when a soccer ball 34 is not present inside the pocket.

FIGS. 6–8 illustrate the various steps of assembly of an alternative shaped pocket 80. FIG. 6 illustrates the unassembled pocket 80. In this alternative embodiment, the unassembled pocket 80 is in the shape of a rectangle. The netting is folded along the net lines 83, 85 and 87 to form the sides of the pocket 80 as illustrated in FIG. 7. The side net lines 81 and 89 are then sewn together, preferably with an overlock stitch. The bottom net lines 92 and 94 are sewn together to form the bottom edge 96 of the pocket 80. FIG. 8 illustrates an assembled alternative pocket 80. The top edges 102, 104, 106 and 108 of the pocket 80 are attached to the perimeter of an aperture 32 on the main net body 22 in the same manner as the cubed pocket 30.

Figure 9:
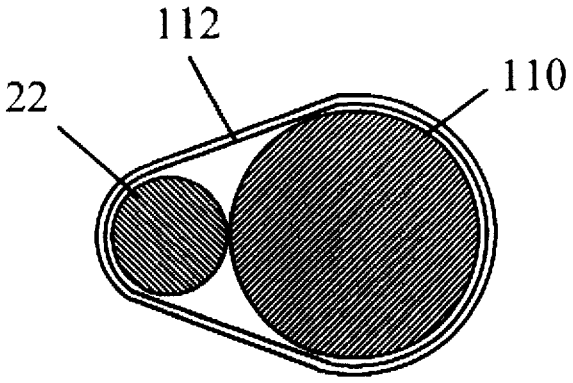
FIG. 9 is a cross-sectional view of the outer cord attached to the outer border of the main body.

The outer border of the main net body 22 is reinforced with an outer cord 110. FIG. 9 illustrates a cross-sectional view of the main net body 22 attached to the outer cord 110. The outer cord 110 increases the strength of the border of the main net body 22. The outer cord 110 is made of flexible material such as knitted nylon, cotton, hemp, polypropylene, rayon, or any other natural or synthetic fiber. The diameter of the outer cord 110 is typically thicker than the net line diameter of the main net body 22. The outer cord 110 is in the range of ⅛ to ½ inch or preferably ¼ to ⅜ inch. The outer cord 110 is attached to the top edge 24, the bottom edge 26, the left side 27 and the right side 29 of the main net body 22 by sewing the outer cord 110 to the square mesh net line. It is preferred that the outer cord 110 be attached to the main net body 22 by an overlock stitch 112 as illustrated in FIG. 9.

Figure 10:
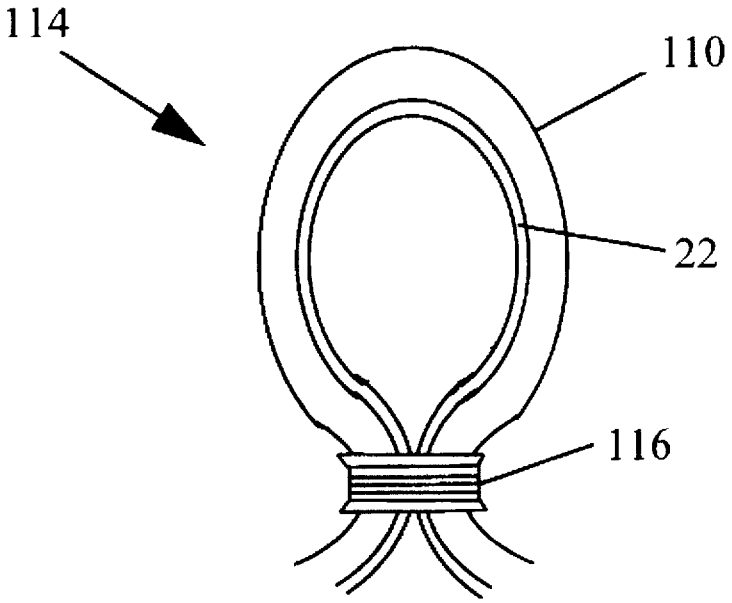
FIG. 10 is an exploded view of the corner loops on the garage door soccer net.

To assist in attaching the garage door soccer net 20 to the outer frame of a garage door, each corner of the garage door soccer net 20 may have a corner loop 114. FIG. 10 illustrates an exploded view of a corner loop 114. The corner loop 114 is made by forming the outer cord 110 and the corner of the main net body 22 into a loop and stitching the base of the loop with thread 116.

Figure 11:
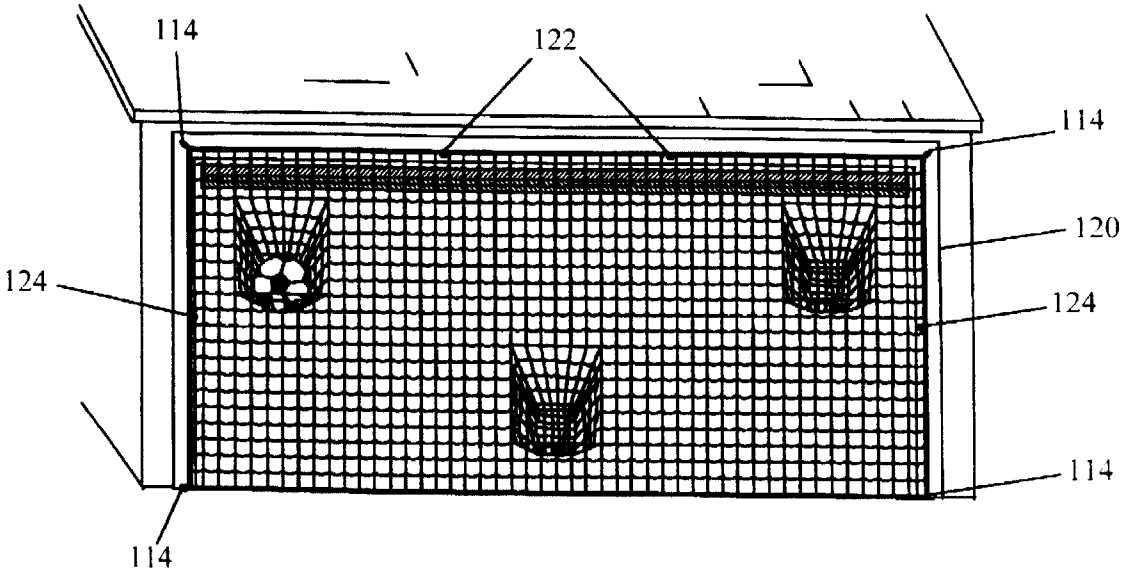
FIG. 11 is a front view of the garage door soccer net installed on the outer frame of an open garage door.
Figure 11:
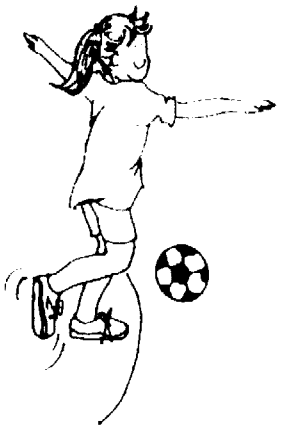

FIG. 11 illustrates the garage door soccer net 20 as installed on the a garage door frame 120. The corner loops 114 are attached to metal hooks or screws located at the four corners of the garage door frame 120. The location of these corner hooks depend on the size of the garage door soccer net 20. To prevent sagging of the top edge 24 of the net 20, one or more metal top hooks 122 may be installed on the top side of the garage door frame 120. The outer cord 110 along the top edge 24 is placed over one or more top hooks 122. To prevent sagging of the sides 27 and 29 of the net 20, one or more metal side hooks 124 may be installed on the sides of the garage door frame 120. The outer cord 110 along sides 27 and 29 is placed over one or more side hooks 124.

The garage door soccer net 20 may also be installed on the side of a house. In this configuration, the two top corner loops 114 and the top edge 24 of the net 20 are attached to metal hooks on the eaves of the house. For additional support, the two bottom corner loops 114 and the bottom edge 26 is staked to the ground. The garage door soccer net 20 should be located far enough from the house to allow the pockets 30 to absorb the impact of the soccer ball 34 without hitting the side of the house. Moreover, the garage door soccer net 20 may be attached to the outer frame of a youth soccer goal. Youth soccer goal frames vary in size but are smaller than a standard soccer goal. One size of a youth soccer goal frame is about 6 feet 6 inches high and 16 feet wide. The garage door soccer net 20 may be attached to the frame of a youth soccer goal by bungee cords, Velcro straps, nylon tie wraps or rope. The attachment is similar to the way a full-size training net is attached to a standard soccer goal frame as discussed below.

The garage door soccer net 20 may also be attached in the inverted position. This enables the upper corner pockets 30 to be located in the lower corners. Pockets located in the upper corners of the garage door net 20 allows a player to develop kicking skills as well as scoring goals by hitting the ball with the player's head, generally known as heading. Pockets in the lower corners of the garage door net 20 enable a player to enhance chip shot skills or rapid ground shots, also known as turf burners.

The garage door soccer net 20 is portable and may be easily transported and stored in a draw-string bag or other small container. In one embodiment of this invention, there is provided an assembly, that comprises, (1) the garage door soccer net 20, (2) metal corner hooks, top hooks 122, and side hooks 124, and (3) a draw-string bag.

In another embodiment of the present invention, the garage door soccer net 20 is used in conjunction with a game. The game enhances the training to young soccer players as well as provides a valuable tool in developing a player's foot and shooting skills. The game also provides an exceptional cardiovascular workout for both young and older athletes. In one game, the game is played using a garage door soccer net 20, a soccer ball 34, and at least two opposing players. The game is started at the end of a driveway opposite to the garage door soccer net 20. A first player begins by taking possession of the soccer ball 34 and kicking the soccer ball 34 forward. The object of the game is to score points by kicking the soccer ball 34 into the main net body 22 or by kicking the soccer ball 34 into one of the two corner pockets 30. A player scores higher points by kicking the soccer ball 34 into one of the two corner pockets 30. For example, one point may be awarded for a soccer ball 34 being kicked into the main net body 22. Two or more points may be awarded for a soccer ball 34 being kicked into one of the two corner pockets 30. To encourage younger players to hit a soccer ball with his or her head, even higher points are awarded when a player knocks a soccer ball 34 into a corner pocket 30. The second player attempts to steal the soccer ball 34 from the first player. The second player also attempts to block the first player from scoring points. If the first player scores or the second player steals the soccer ball 34 from the first player, the second player then takes possession of the soccer ball 34. The second player returns the soccer ball 34 to the end of the driveway opposite to the garage door soccer net 20. The second player then attempts to score points in the same manner as the first player. The game may be played with or without a goalie. If no goalie is used, the middle pocket 30 and middle aperture 32 represent the goalie. If the soccer ball 34 is kicked into the unguarded middle pocket 30, the ball is turned over to the second player who then attempts to score points. If a goalie is used, points are awarded to a player who kicks the soccer ball 34 into the middle pocket 30. For example, three points may be awarded for a soccer ball 34 that is kicked into the guarded middle pocket 30. The game may end after the expiration of a certain time period. The player with the most points wins. Alternatively, the game may end when one player reaches a certain point total.

In another game, the garage door soccer net 20 has different colored pockets 30. This game is played with at least two opposing players, each with a soccer ball 34. Each player is designated a different colored pocket 30. The game is started at the end of the driveway opposite to the garage door soccer net 20. A player begins by attempting to kick the soccer ball 34 into their designated colored pocket 30. A player scores points by kicking the soccer ball 34 into their designated colored pocket 30. The game may end when one player reaches a certain point total.

In still another game, there is a garage door soccer net 20, a soccer ball 34, and at least two opposing players. The garage door soccer net 20 has different colored corner pockets 30. Each player picks a different colored corner pocket 30. A first player begins by taking possession of the soccer ball 34 and attempting to kick the soccer ball 34 into the first player's designated pocket 30. The second player attempts to steal or otherwise obtain the soccer ball 34 from the first player. The second player also attempts to block the first player from kicking the soccer ball 34 into the first player's designated pocket 30. A point is awarded to the first player if the first player kicks the soccer ball 34 into the first player's designated pocket 30. If the first player scores a point or the second player steals the soccer ball 34 from the first player, the second player takes possession and then attempts to kick the soccer ball 34 into the second player's designated pocket 30. A point is awarded to the second player if the second player kicks the soccer ball 34 into the second player's designated pocket 30. The second player may also obtain possession of the soccer ball 34 if the first player kicks the soccer ball 34 into a center pocket 30. The game may end after the expiration of a certain time period. The player with the most points wins the game. Alternately, the game may end when one player reaches a certain point total.

Figure 12:
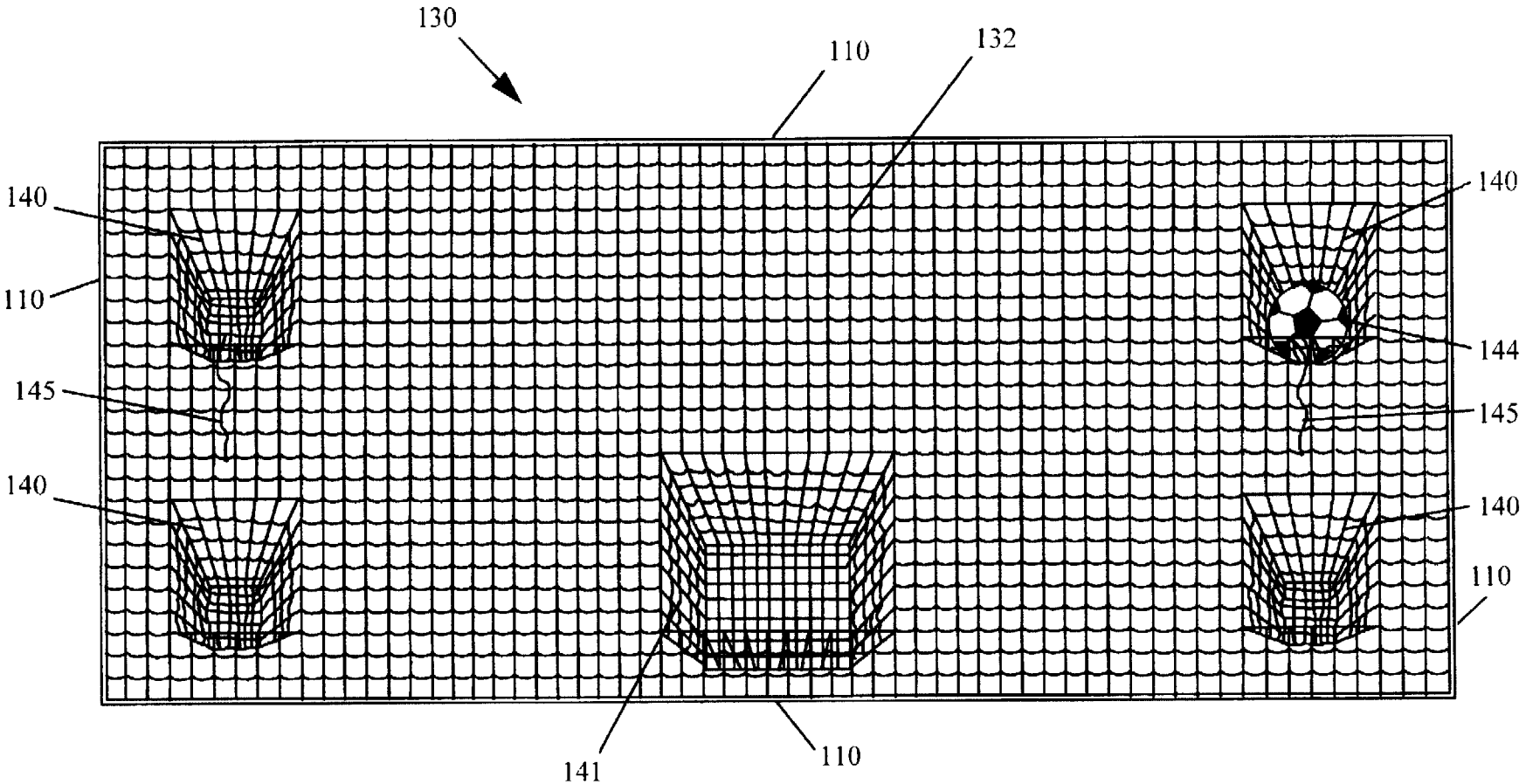
FIG. 12 is a front view of the full size training net.
Figure 13:
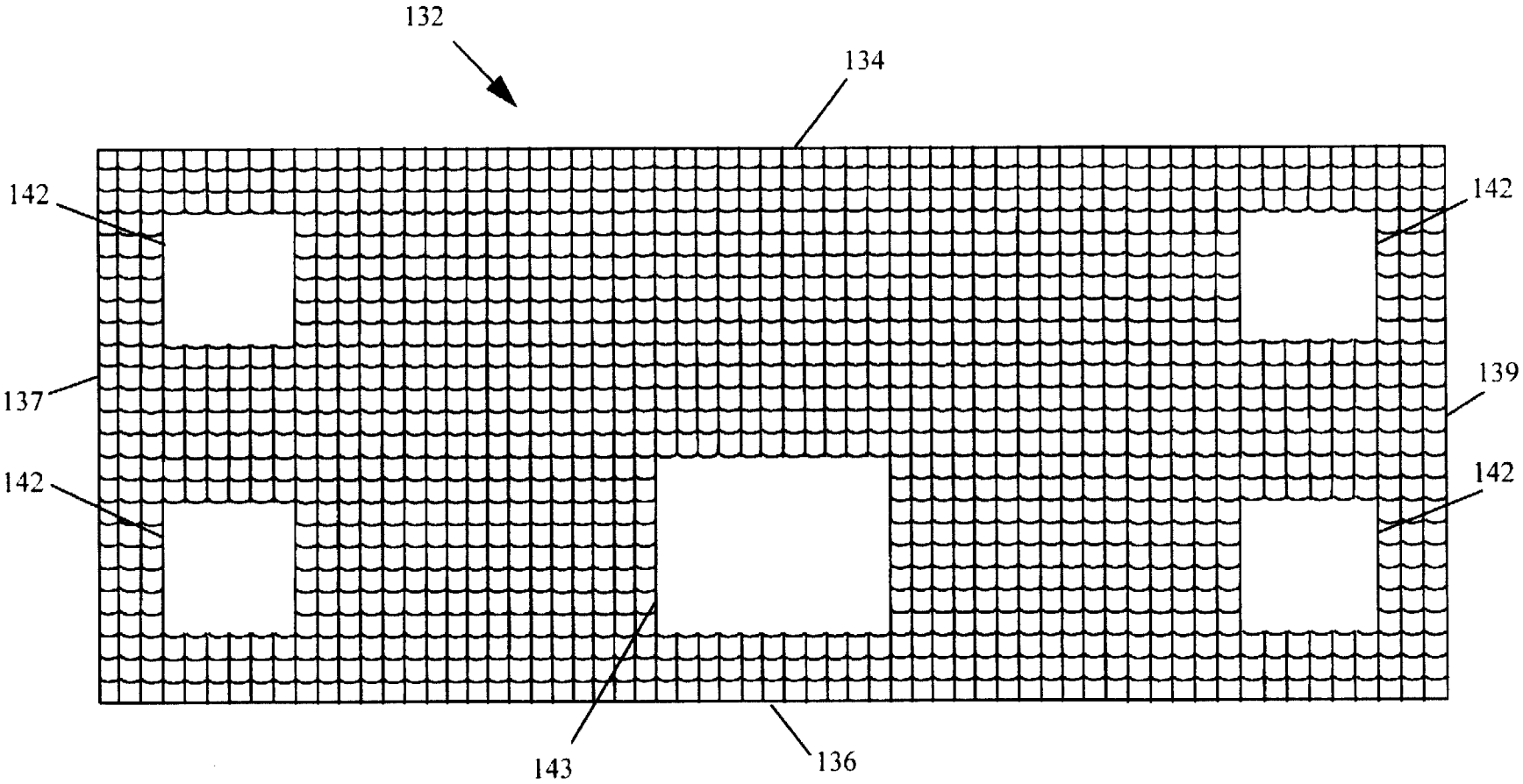
FIG. 13 is a front view of the main body of the full size training net.

FIGS. 12–13 illustrate another embodiment of the present invention, a full-size training net 130. The training net 130 has a main net body 132 that is rectangular in shape. The main net body 132 has a top edge 134, a bottom 136, a left side 137, and a right side 139. The full-size training net 130 is sized for use on the frame of a standard soccer goal. A standard soccer goal frame has an opening of 8 feet high and 24 feet wide. Thus, the top edge 134 and bottom edge 136 have a preferred length of about 24 feet. The left side 137 and right side 139 have a preferred height of 8 feet.

The main net body 132 is also constructed of knitted nylon, cotton, hemp, polypropylene, rayon or any other natural or synthetic fiber suitable for netting. The netting square mesh has a width and height in the range of 3 to 6 inches. It is preferred that the square mesh have a width and height of about 4 inches. The diameter of the net line is in the range of 1/16 to 1/4 inch.

The full-size training net 130 has multiple corner pockets 140 and at least one center pocket 141. Each corner pocket 140 is attached to the perimeter of a corner aperture 142. The center pocket 141 is attached to the perimeter of a center aperture 143. In the preferred embodiment the full-size training net 130 has at least four corner pockets 140 and one center pocket 141. The corner pockets 140 may be assembled and attached to the apertures 142 in the same manner as the pockets 30 are assembled and attached to the apertures 32 of the garage door soccer net 20. The corner pockets 140 and center pocket 141 have a preferred shape of a cube or a rectangular box. The corner apertures 142 and center aperture 143 are preferably in the shape of a square or rectangle. The center pocket 141, however, is typically larger than a corner pocket 140. The center pocket 141 represents the goalie position. The center pocket 141 is constructed in the same manner as the corner pockets 140, but with a larger piece of net. The corner apertures 142 have a height and width in the range of 20 to 36 inches. The center aperture 143 has a height and width in the range of 2 to 4 feet.

The corner pockets 140 and center pocket 141 are located to develop a player's foot and shooting skills. Specifically, the corner pockets 140 and corner apertures 142 are located at the corners of the training net 130 as illustrated in FIGS. 12–13. These locations represent the best areas for a player to score during a soccer game. By placing pockets 140 in these areas, a player may develop critical shooting skills. The upper corner pockets allow a player to practice high kicking shots or head shots. The lower corner pockets enable a player to develop turf burner shots. The center of the upper left-hand corner aperture 142 is located between 5 and 7 feet from the ground and between 2 and 5 feet from the left side 137. The center of the lower left-hand corner aperture 142 is located between 16 inches and 3 feet from the ground and between 2 and 5 feet from the left side 137. The center of the upper right-hand corner aperture 142 is located between 5 and 7 feet from the ground and between 2 and 5 feet from the right side 139. The center of the lower right-hand corner aperture 142 is located between 16 inches and 3 feet from the ground and between 2 and 5 feet from the right side 139.

The height of the upper left-hand corner and upper right-hand corner pockets 140 makes it difficult for young players to retrieve a captured soccer ball 144. Thus, a retrieval cord 145 may be used. One end of the retrieval cord 145 may be attached to the bottom of the upper left-hand corner and upper right-hand corner pockets 140. The retrieval cord 145 extends through the apertures 142 and down the front face of the main net body 132. The other end of the retrieval cord 145 may be attached to the front face of the main net body 132. A player may simply pull on the retrieval cord 145 to release the captured soccer ball 144.

The outer border of the main net body 132 is reinforced with an outer cord 110. The outer cord 110 diameter is preferably 1/4 to 3/8 inch. The outer cord 110 is attached to the top edge 134, the bottom edge 136, the left side 137 and the fight side 139 of the main net body 132 by sewing the outer cord 110 to the square mesh net line. An overlock stitch is preferred.

The full-size training net 130 is a valuable tool for coaches and trainers. The netting of the pockets 140 may be dyed different colors to distinguish one pocket from another. The pockets 140 may also be color distinguished by attaching a colored piece of fabric to the bottom of the pocket 140 or using colored thread when sewing a pocket 140 to an aperture 142. By using different colored pockets 140, a coach may call out the color of a certain pocket 140 as a player dribbles toward the practice net 130. During an actual scrimmage, one team can take a pocket 140 of one color and the other team a pocket 140 of a different color thus creating a very fast pace game with rapid switches from offense to defense. This develops both the body and the mind causing a player to make snap decisions. Other games, similar to those described for the garage door soccer net 20, may be used with the full-size training net 130.

Figure 14:
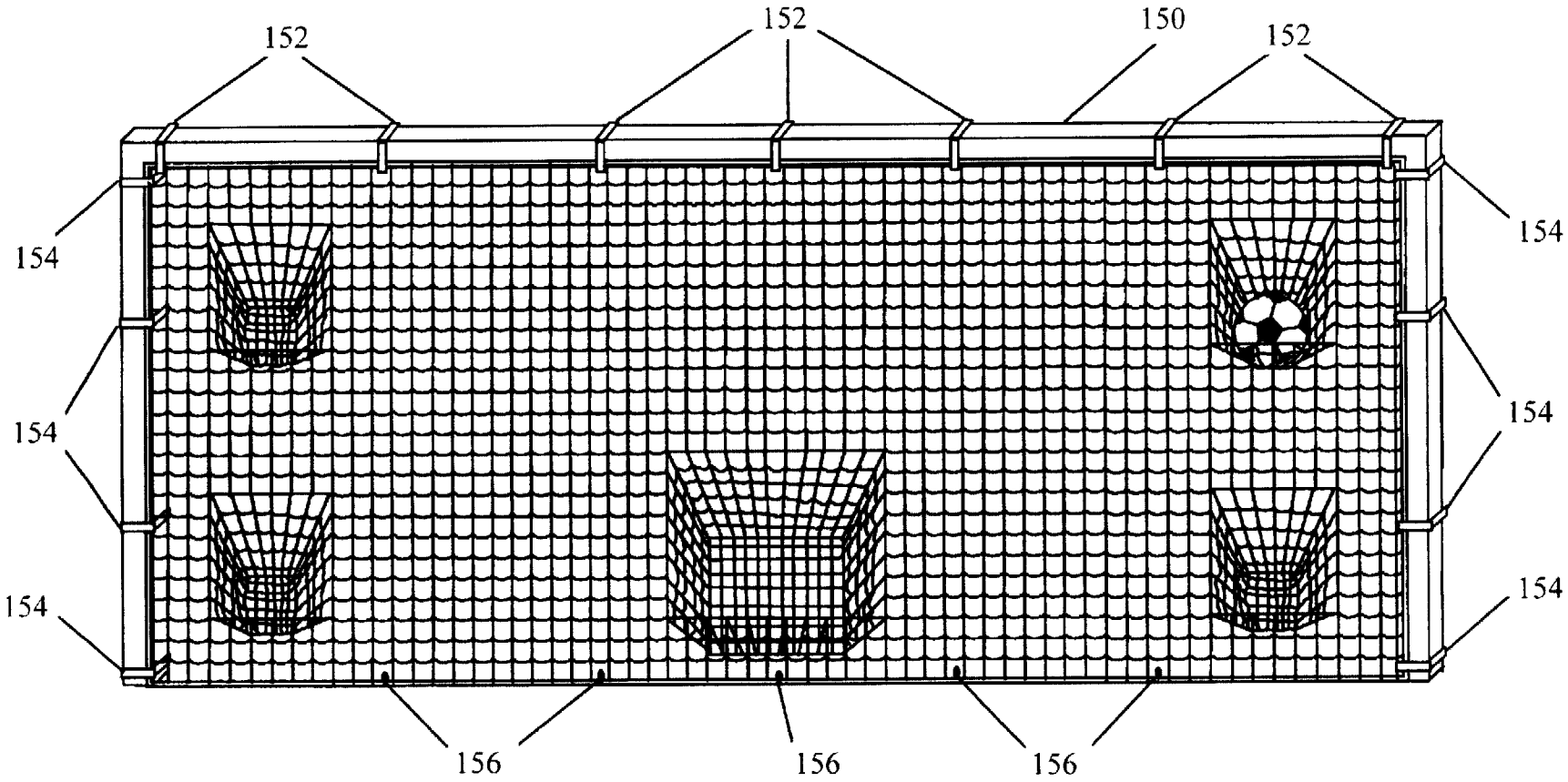
FIG. 14 is a front view of the full size training net attached to the frame of a soccer goal.

FIG. 14 illustrates the full-size training net 130 attached to a soccer goal frame 150. The top edge 134 of the training net 130 may be attached to the top beam of the soccer goal frame 150 by using Velcro straps 152. The left side 137 and the right side 139 of the training net 130 may be attached to the side beams of the soccer goal frame 150 by using Velcro straps 154. There are a variety of other methods of attaching the training net 130 to the soccer goal frame 150 including, but not limited to, using bungee cords, nylon tie wraps or rope. For additional support, the bottom edge 136 of the training net 130 may be attached to the ground with stakes 156.

The full-size training net 130 is portable and may be easily transported and assembled to a variety of pre-existing structures. The full-size training net 130 may be folded up or rolled up and carried in a draw-string bag. In one embodiment of this invention, there is provided an assembly, that comprises, (1) the full-sized training net 130, (2) Velcro straps 152 and 154, bungee cords or nylon tie wraps, (3) and a draw-string bag.

Figure 15:
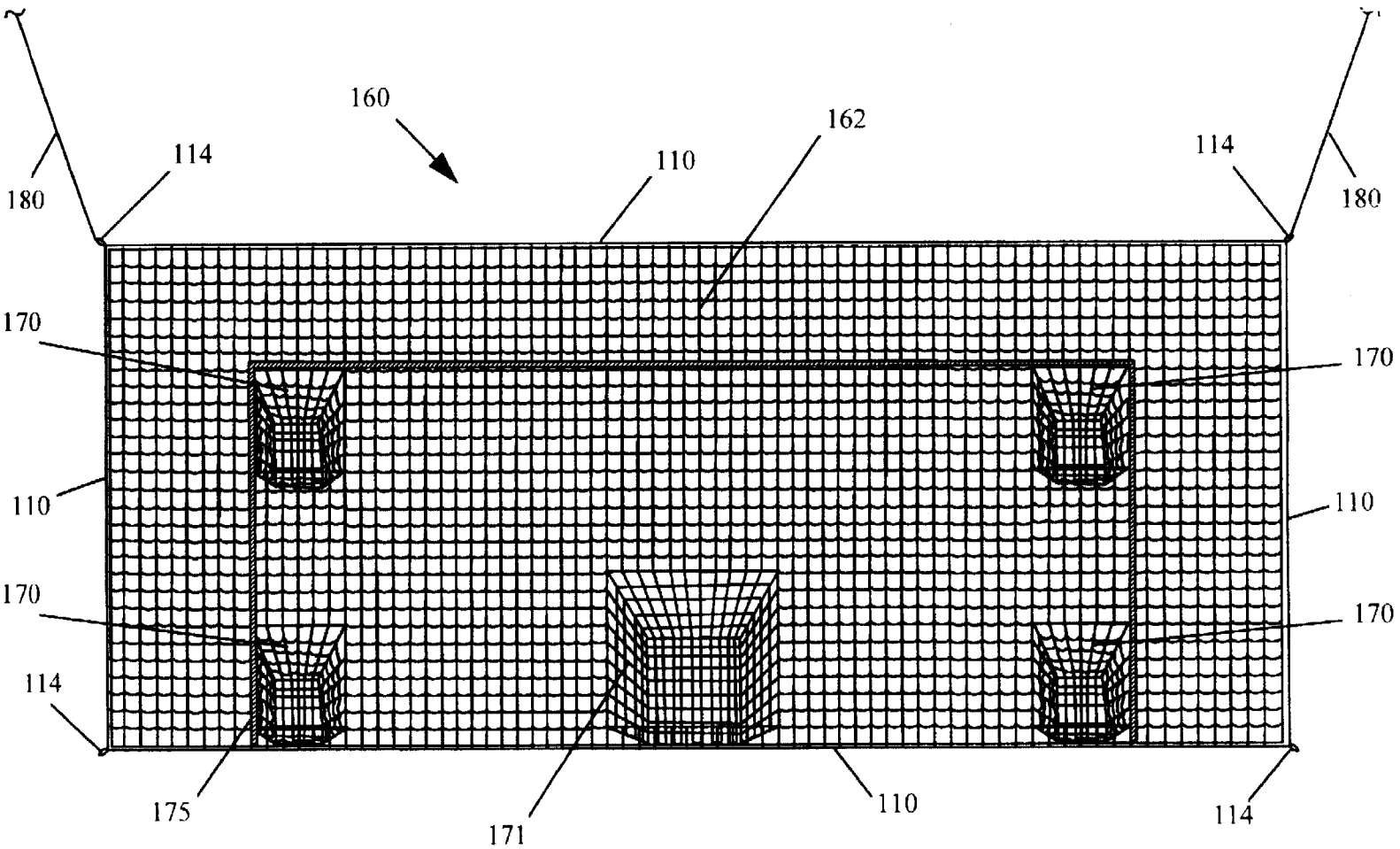
FIG. 15 is the front view of the gym ball net.
Figure 16:
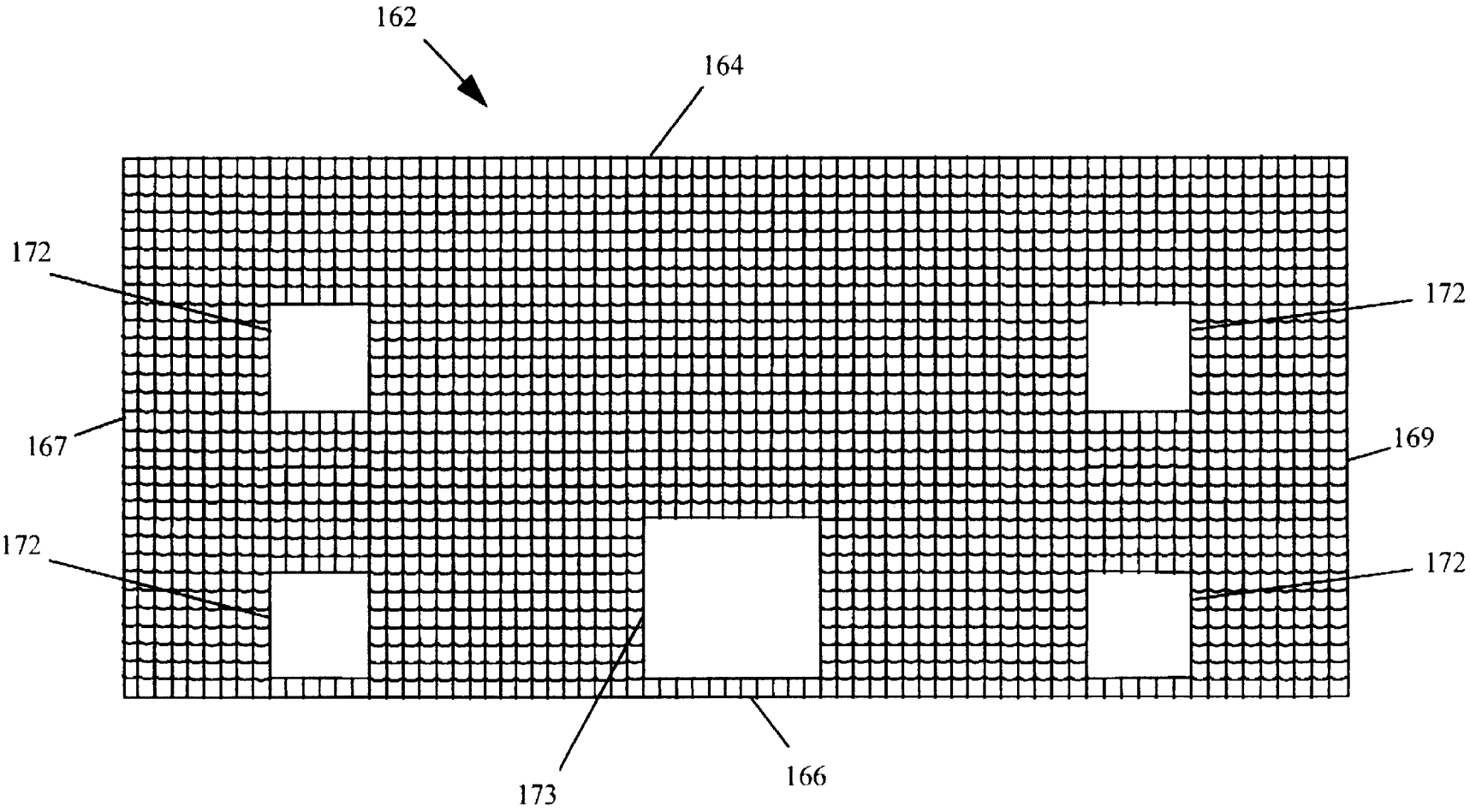
FIG. 16 is the front view of the main body of the gym ball net.

FIGS. 15–16 illustrates yet another embodiment of the present invention, a gym ball net 160. The gym ball net 160 is used inside a gymnasium or other large enclosure. The gym ball net 160 has a main net body 162 in the shape of a rectangle. The main net body 162 has a top edge 164, a bottom edge 166, a left side 167, and a right side 169. The gym ball net 160 is larger than the garage door soccer net 20 or the full size training net 130. Yet the pockets are still located in the critical shooting areas of a goal. These critical shooting areas include the four corners of a standard soccer goal having a width of about 24 feet and a height of about 8 feet. It is preferred that the width of the gym ball net 20 and the height of he gym ball net 20 extend about 4 feet beyond the size of a standard soccer goal. Thus, the top edge 164 and bottom edge 166 have a length of about 28 to 36 feet. In the preferred embodiment, the top edge 164 and bottom edge 166 have a length in the range of 32 to 34 feet. The left side 167 and right side 169 have a height in the range of 10 to 14 feet. Preferably, the left side 167 and right side 169 have a height of about 12 feet. The gym ball net 160 is larger than a standard soccer goal to prevent a soccer ball from traveling past the gym ball net 160 and to protect the inside of the gymnasium or other large enclosure. The main body 162 is constructed of lightweight natural or synthetic fiber netting such as knitted nylon, cotton, hemp, polypropylene or rayon. The netting of the main body 162 has a square mesh having a width and height in the range of 3 to 6 inches or preferably of about 4 inches. The gym ball net may also have a colored ribbon or line 175 that represents the outline of a standard soccer goal having a height of 8 feet and a width of 24 feet. The ribbon or line 175 may be made of thin colored fabric and sewn to the main net body 162. Alternatively, the colored line 175 may be formed by simply dyeing the net line on the main net body 162.

The gym ball net 160 has multiple corner pockets 170 and at least one center pocket 171 that are attached to the perimeter of the corner apertures 172 and center aperture 173. The corner pockets 170 and center pocket 171 are assembled and attached to the main net body 162 in the same manner as the pockets 30 are assembled and attached to the main net body 22 of the garage soccer net 20. The corner pockets 170 and center pocket 171 are shaped to receive one or more soccer balls. The preferred shape of a corner pocket 170 and a center pocket 171 is a cube or rectangular box. The center pocket 171 is typically larger than the corner pockets 170. The corner apertures 172 have a width in the range of 20 to 36 inches and a height in the range of 20 to 36 inches. The center aperture 173 has a width in the range of 2 to 4 feet and a height in the range of 2 to 4 feet.

The center of the upper left-hand corner and upper right-hand corner apertures 173 are located between 5 and 7 feet from the ground or the bottom edge 166. The center of the lower left-hand corner and upper right-hand corner apertures 173 are located between 16 inches and 3 feet from the ground or the bottom edge 166. Due to the height of the upper left-hand corner and upper right-hand corner pockets 170, a retrieval cord may be attached to the bottom of these pockets to enable a player to release a captured ball. This retrieval cord may be similar to the retrieval cord 145 on the full-size training net 130.

The gym ball net 160 may be suspended from the ceiling of a gymnasium or other large enclosure. The gym ball net 160 has a reinforcing cord 110 that extends along the top edge 164, the bottom edge 166, the left side 167 and the right side 169 of the main net body 162. The reinforcing cord 110 may also be looped at the corners to form corner loops 114. The bottom corner loops 114 or the bottom edge 164 may be attached to flush-mounted receptacles on the gynmasium floor. The top corner loops 114 or top edge 162 may be attached to a rope or cord 180 and lifted into place by pulleys located on the ceiling of the gymnasium or other large enclosure. It is preferred that the gym ball net 160 be placed far enough from the wall of the gymnasium or other large enclosure so that the pockets will absorb the impact of the soccer ball and avoid hitting the wall. Additionally, it is preferred that the top edge 164 be slightly tilted forward to assist in the return of missed shots.

In another embodiment of the present invention, the gym ball net 160 is used in conjunction with a game. The game provides a valuable tool in developing a player's soccer skills. The game also provides a great cardiovascular workout for both young and older athletes. In one game, the game is played with a gym ball net 160, a soccer ball, and at least two opposing players. If more than two players are present, the players may be divided into two opposing teams. A first player or team begins by kicking forward the soccer ball. The object of the game is to score points by kicking the soccer ball into one of the corner pockets 170. Higher points may be awarded if a player knocks a soccer ball into a corner pocket 170 using his or her head. The increased points encourages young players to use head shots. The opposing player of team attempts to block the first player or team from kicking the soccer ball into the corner pockets 170. The opposing player or team may also attempt to steal the soccer ball from the first player or team. The game may be played with or without a goalie. If no goalie is used, the center pocket 171 and center aperture 173 represent the goalie. If the soccer ball is kicked into the center pocket 171, the ball is turned over to the opposing player or team who then attempts to score points. If a goalie is used, then points are awarded to the player or team who kicks the soccer ball into the center pocket 171. For example, three points may be awarded for a soccer ball that is kicked into a guarded center pocket 171. Points are awarded only when a ball is actually contained within the corner pockets 170 or the center pocket 171, in the case of a goalie. This eliminates disagreement between players of actual points scored.

Thus, there is disclosed in the above description and the drawings, training devices which fully and effectively accomplish the objects of this invention. However, it will be apparent that variations and modifications of the disclosed embodiments may be made without departing from the principles of the invention or the scope of the appended claims.

What is claimed is:

1. An athletic training device, which comprises:

a) a flexible body component, said body component having a top edge, a bottom edge, and two side edges, said body component having a plurality of apertures, each aperture having a substantially square perimeter; and b) a plurality of pockets extending outwardly from the plane defined by said body component, said pockets being interconnected to said aperture perimeters, said pockets being adapted to receive at least one soccer ball.

2. The device of claim 1, wherein said apertures have a width in the range of 20 to 36 inches and a height in the range of 20 to 36 inches.

3. The device of claim 1, wherein said pockets being substantially cubed, said pockets having a width in the range of 20 to 36 inches, a length in the range of 20 to 36 inches and a depth in the range of 20 to 36 inches.

4. The device of claim 1, wherein at least one aperture being located in the range of 4 to 5 feet from the bottom edge of said body component.

5. The device of claim 1, further comprising a rigid garage door frame having a horizontal member and two vertical members, a means for interconnecting said device to said horizontal member and vertical members of said garage door frame.

6. An athletic training device, which comprises:

a) a body component having a top edge, a bottom edge, and two side edges, said body component made of flexible net material, said body component being substantially rectangular, said body component having a plurality of apertures, each aperture having an outer perimeter;

b) a plurality of pockets extending outwardly from the plane defined by said body component, said pockets being interconnected to said perimeters of said apertures, said pockets shaped for receiving at least one soccer ball; and c) an outer cord interconnected to the top edge, bottom edge, and two side edges of said body component.

7. The device of claim 6, wherein at least one aperture perimeter being substantially square, said at least one aperture perimeter having a width in the range of 20 to 36 inches and a height in the range of 20 to 36 inches.

8. The device of claim 6, wherein at least one pocket being substantially cubed, said at least one pocket having a width in the range of 20 to 36 inches, a length in the range of 20 to 36 inches and a depth in the range of 20 to 36 inches.

9. The device of claim 6, wherein at least one aperture being located in the range of 4 to 5 feet from said bottom edge of said body component.

10. The device of claim 6, wherein said flexible netting material is selected from the group of knitted nylon, cotton, hemp, polypropylene, and rayon.

11. The device of claim 6, further comprising a rigid frame having a horizontal member and two vertical members, a means for interconnecting said device to said horizontal member and vertical members of said rigid frame.

12. The device of claim 6, further comprising a rigid garage door frame having a horizontal member and two vertical members, a means for interconnecting said device to said horizontal member and vertical members of rigid garage door frame.

13. The device of claim 6, further comprising a rigid soccer goal frame having a horizontal member and two vertical members, a means for interconnecting said device to said horizontal member and vertical members of said soccer goal frame.

14. A method of assembling an athletic training device, which comprises:

a) cutting a flexible net material into a body component having a top edge, a bottom edge, and two side edges;

b) cutting a plurality of apertures in said body component, each aperture having a substantially square perimeter;

c) forming a plurality of pockets, at least one pocket having an opening that is substantially square;

d) attaching the substantially square opening of at least one pocket to said perimeter of said aperture; and e) attaching an outer cord to said top edge, bottom edge and side edges of said body component.

15. A method as recited in claim 14, wherein said flexible net material is selected from the group consisting of knitted nylon, cotton, hemp, polypropylene, and rayon.

16. A soccer training game, which comprises:

a) a soccer ball; and b) a soccer training device having a flexible body component, said body component having a top edge, a bottom edge, and two side edges, said body component having a plurality of apertures, each aperture having a substantially square perimeter, said training device having a plurality of pockets, said pockets interconnected to said perimeters of said apertures.

17. The soccer training game of claim 16, wherein at least one aperture has a width in the range of 20 to 36 inches and a height in the range of 20 to 36 inches.

18. The soccer training game of claim 16, wherein at least one pocket being substantially cubed, said at least one pocket having a width in the range of 20 to 36 inches, a length in the range of 20 to 36 inches and a depth in the range of 20 to 36 inches.

19. The soccer training game of claim 16, wherein at least one aperture being located in the range of 4 to 5 feet from said bottom edge of said body component.

20. A method of playing a game with a soccer ball and an athletic training device, said training device having a flexible rectangular body component, said body component having at least two corner apertures and a center aperture, said training device having at least two corner pockets, said training device having at least one center pocket, each corner pocket being interconnected to each corner aperture, said center pocket being interconnected to said center aperture, there being at least a first player and a second player, the method comprising:

a) the kicking of said soccer ball by said first player through at least one corner aperture and into at least one corner pocket; and b) the blocking of said soccer ball by said second player from entering at least one corner aperture and into at least one corner pocket.

* * * * *